US008108971B2

(12) United States Patent
Florek

(10) Patent No.: US 8,108,971 B2
(45) Date of Patent: Feb. 7, 2012

(54) HINGE FOR A ROOF WINDOW WITH A PIVOT SASH

(75) Inventor: Ryszard Florek, Nowy Sacz (PL)

(73) Assignee: Fakro PP Spolka Z O.O., Nowy Sacz (PL)

( * ) Notice: Subject to any disclaimer, the term of this patent is extended or adjusted under 35 U.S.C. 154(b) by 222 days.

(21) Appl. No.: 12/443,115

(22) PCT Filed: Oct. 9, 2007

(86) PCT No.: PCT/PL2007/000068

§ 371 (c)(1), (2), (4) Date: Apr. 9, 2009

(87) PCT Pub. No.: WO2008/044953

PCT Pub. Date: Apr. 17, 2008

(65) Prior Publication Data

US 2010/0071163 A1 Mar. 25, 2010

(30) Foreign Application Priority Data

Oct. 9, 2006 (PL) ..... 380795

(51) Int. Cl.
*E05D 11/06* (2006.01)

(52) U.S. Cl. ..... 16/357; 16/193; 16/50; 49/386

(58) Field of Classification Search ..... 16/357, 16/348, 193, 197, 50; 403/116; 49/386
See application file for complete search history.

(56) References Cited

U.S. PATENT DOCUMENTS

| | | | | | |
|---|---|---|---|---|---|
| 4,796,331 | A | * | 1/1989 | White et al. | 16/324 |
| 5,271,124 | A | * | 12/1993 | Sandell | 16/370 |
| 5,568,702 | A | * | 10/1996 | Frank et al. | 49/153 |
| 5,568,703 | A | * | 10/1996 | Frank et al. | 49/153 |

FOREIGN PATENT DOCUMENTS

| | | | |
|---|---|---|---|
| EP | 1760234 | A1 * | 3/2007 |
| WO | 99/28581 | | 6/1999 |
| WO | 2005/019575 | | 3/2005 |
| WO | WO 2008010735 | A1 * | 1/2008 |
| WO | WO 2008013464 | A1 * | 1/2008 |
| WO | WO 2010003411 | A1 * | 1/2010 |
| WO | WO 2010005331 | A1 * | 1/2010 |

* cited by examiner

*Primary Examiner* — William L. Miller
(74) *Attorney, Agent, or Firm* — Dennison, Schultz & MacDonald

(57) ABSTRACT

A pivot hinge for roof windows with a sash pivoting around the axis located between the upper and the lower member of a window, has a balancing system, which ensures the state of equilibrium of a window sash when its centre of gravity is located outside the sash rotating axis and the friction spring of the hinge is unable to hold the sash pivoted in each its position. At the same time the window fittings, its assembly, installation in a roof and its appearance remain unchanged. Also the method of separating of both hinge parts (taking a sash out of a window frame) remains unchanged.

9 Claims, 4 Drawing Sheets

HINGE FOR A ROOF WINDOW WITH A PIVOT SASH

BACKGROUND OF THE INVENTION

The present invention concerns a hinge for a roof window with a sash pivoting around an axis located between the upper and the lower member of a window.

A roof window with a pivot function is at both sides equipped with pivot hinges, comprising two hinge parts, one hinge part secured to the side member of a window frame, and the other hinge part secured to the side member of a sash. Each hinge part has a base plate for securement by fastening screws through screw holes.

One side of each base plate has additional means for securing the plate to a window frame or a sash and the other side of the base plate has members mating one another, which connect both plates, enabling their separation, and enable pivoting of the base plates relative to each other. The members constitute: an arched, one-sided open guide with a friction spring located on the base plate secured to a window frame, and a pivoting hook with an arch-bent arm, a guide pin and a bumper for limiting hook pivoting located on the base plate secured to a sash, at the same time the arm-bent hook arm and the guide pin mate the arched guide and the friction spring.

Pivot hinges in roof windows are secured between the upper and the lower window member, usually in a place that ensures the balance of a sash in the open position of a window. The balance is achieved when the centre of gravity of a window sash is in its rotation axis or in such a distance from the rotation axis that the hinge friction spring is able to keep an unbalanced sash in any rotational position. Therefore the rotation axis of a roof window sash is usually located at a little distance from the half of the window height. A bigger shift of the sash rotation axis or any additional equipment on any of its parts, the lower or the upper, disturbs the balance and causes that a window is unable to hold its sash in each ajar position and a user operating the window has to use more strength to overcome the unbalanced weight of the sash.

A roof pivot window is known from applications WO2005/019574, which is equipped with a known pivot hinge, of the rotation axis located in the upper half of a window, sash, in addition it is equipped with at least one auxiliary device independent from the hinge, presented as a cylinder, which carries the lower, heavier part of a window sash. The device is at one end secured to a window frame and at the other end it is secured to a window sash, in addition the securement allows to separate the device from the window frame.

The auxiliary device constitutes an additional fixture of a roof window and it requires performing of additional activities during assembly of a window and during installation of a window in a roof, it deteriorates aesthetics of the window in an ajar position of the sash, moreover if the need arises to remove a sash from a window frame the cylinder must be disconnected from the window frame beforehand.

SUMMARY OF THE INVENTION

The object of the present invention is a pivot hinge with a balancing system for roof windows with a sash pivoting around the axis located between the upper and lower member of a window, which ensures the state of equilibrium of a window sash when its centre of gravity is located beyond the sash rotating axis and the friction spring of the hinge is unable to hold the sash pivoted in each its position. At the same the time the window fittings, its assembly and installation in a roof as well as its appearance remain unchanged. Also the method of separating both hinge parts—taking a sash out of a window frame—remains unchanged.

BRIEF DESCRIPTION OF THE DRAWINGS

A hinge for roof windows, according to the present invention, is presented in embodiment examples on a drawing where.

DESCRIPTION OF THE PREFERRED EMBODIMENTS

Example I

Figure 1:
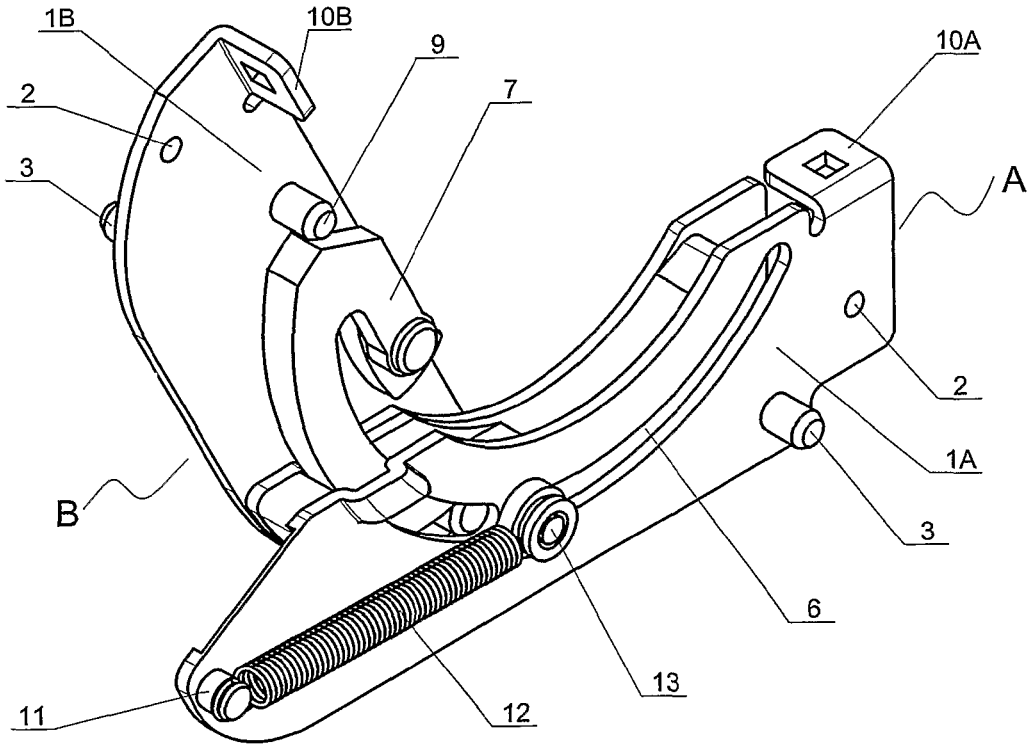
FIG. 1 and FIG. 2 present a view of a hinge with a balancing system in the open and closed positions of a sash —in the first embodiment.
Figure 2:
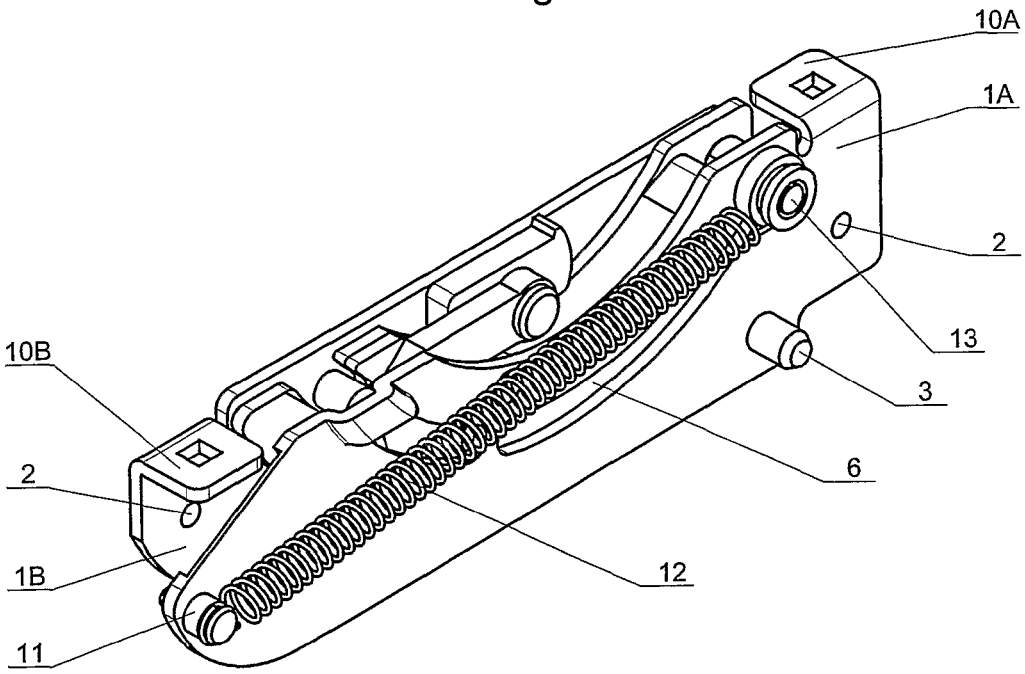
Figure 3:
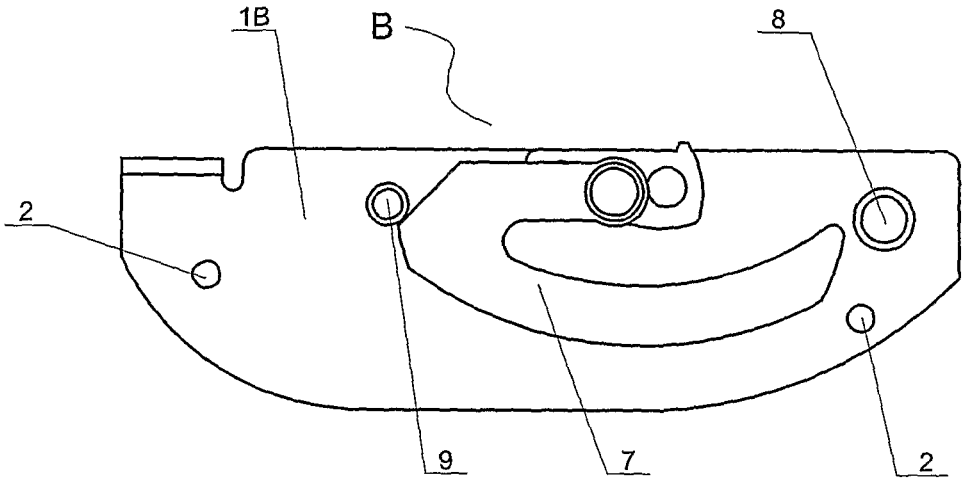
FIG. 3 shows the surface of the hinge base plate B mating the plate A—suitable for all embodiments described and presented in the drawings.
Figure 4:
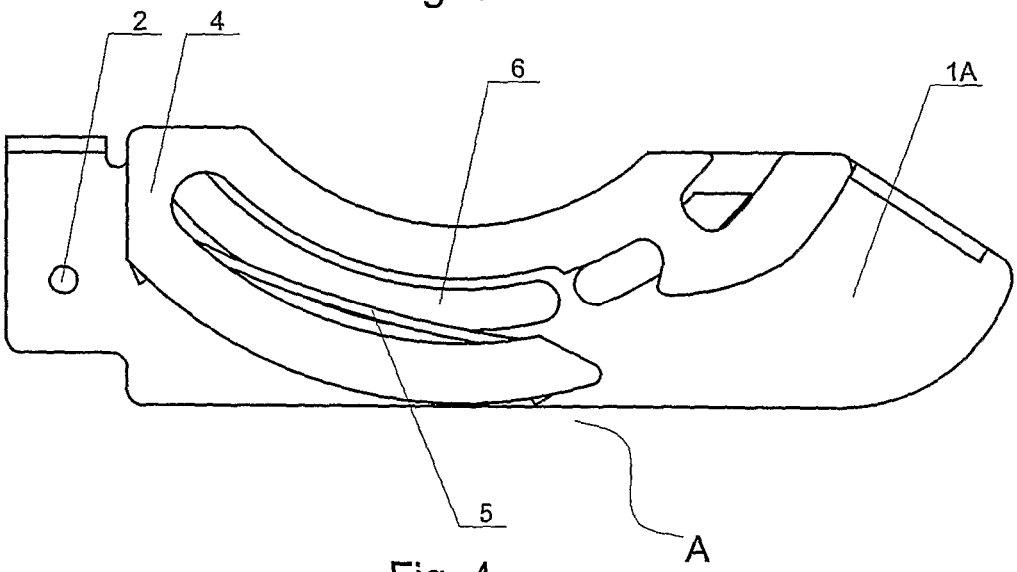
FIG. 4 shows the hinge base plate A viewed from the side mating the plate B, in the first embodiment.
Figure 5:
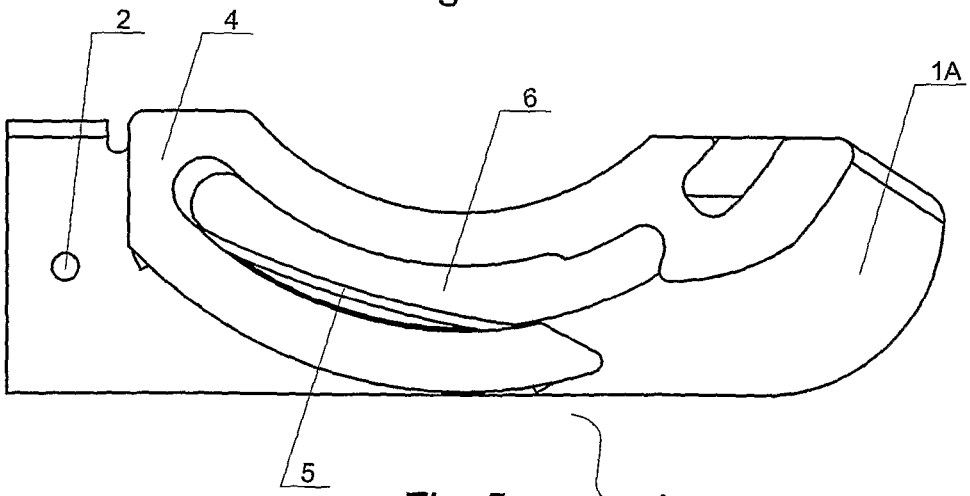
FIG. 5 shows the hinge base plate A viewed from the side of the mating surfaces in the second and the third embodiment.
Figure 6:
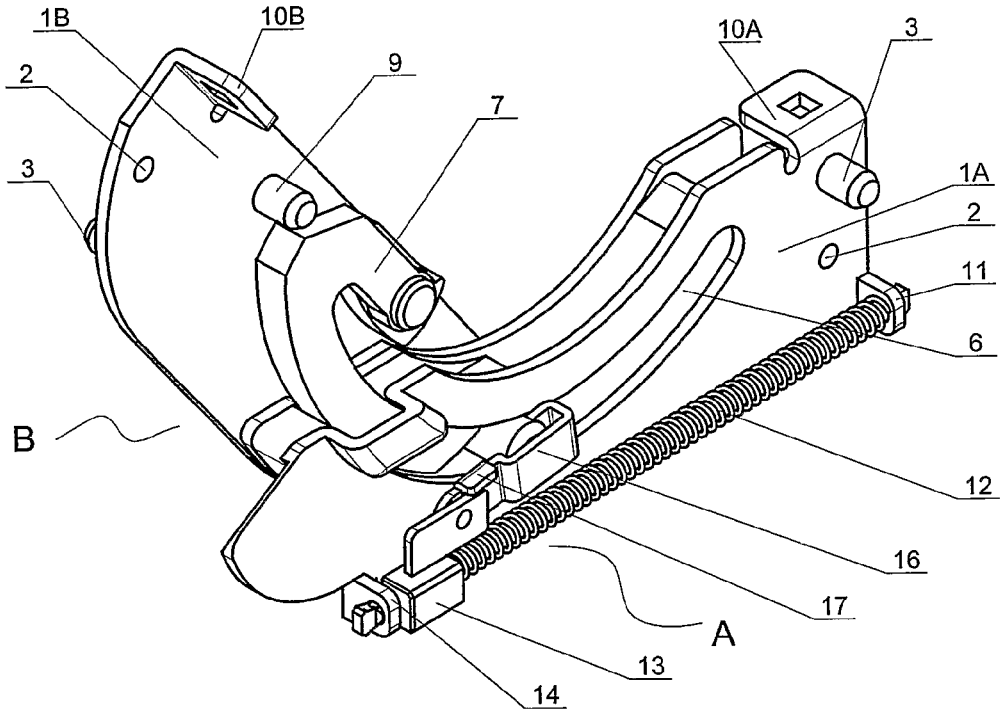
FIG. 6 and FIG. 7 present a view of a hinge with a balancing system in the open and closed positions of a sash—in the second embodiment.
Figure 7:
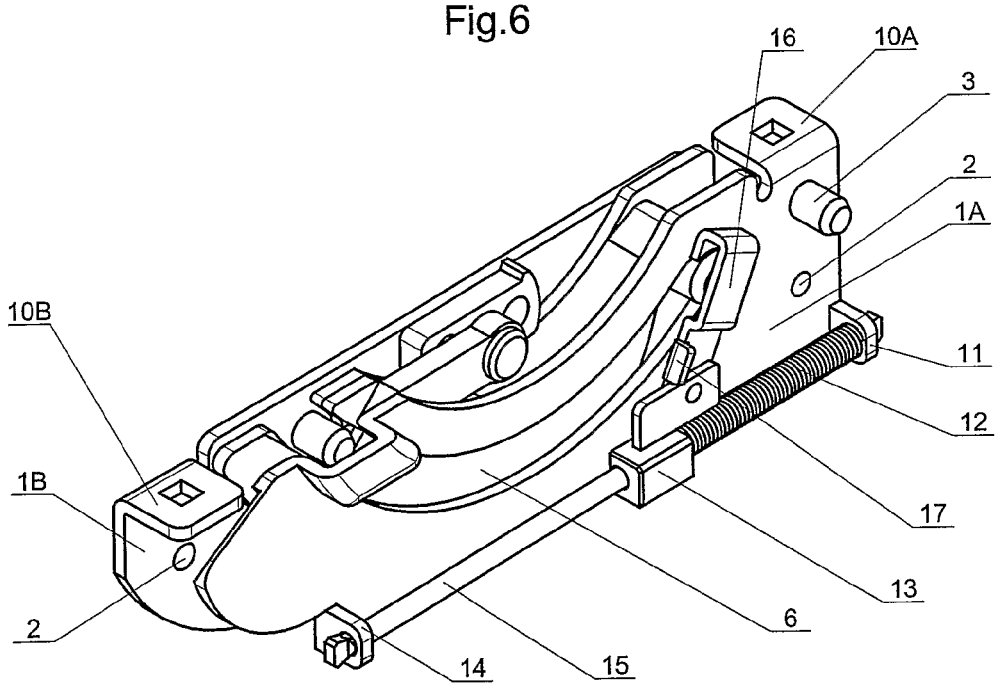
Figure 8:
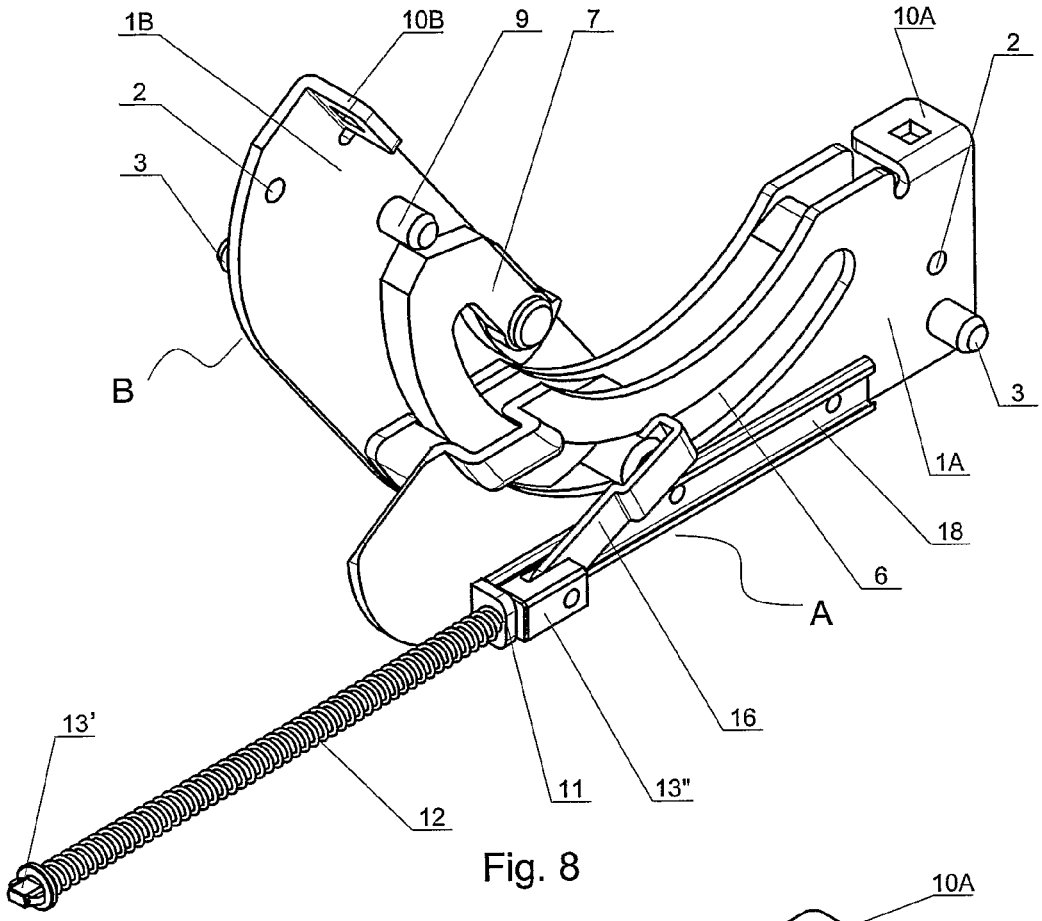
FIG. 8 and FIG. 9 present a view of a hinge with a balancing system in the open and closed positions of the sash—in the third embodiment.
Figure 9:
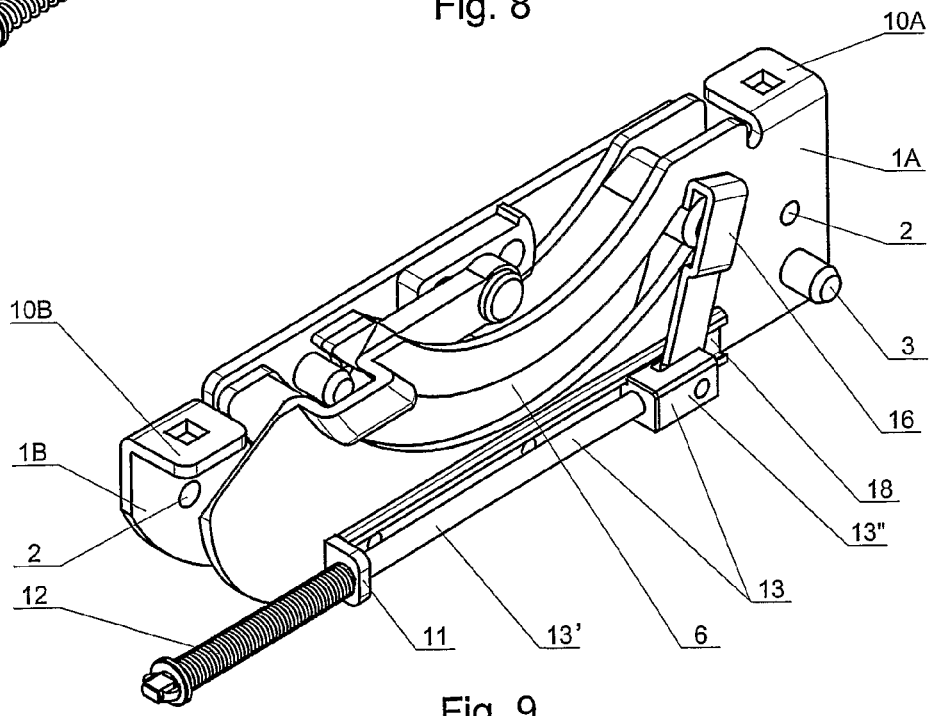

A hinge for a roof window with a pivot sash comprises a hinge part A, secured to the side member of a window frame and a hinge part B secured to the side member of a sash frame. Both hinge parts have base plates 1A and 1B with screw holes 2 for fastening screws with additional fastening members 3 on one surface. At the other surface the base plate 1A has an arch-bent guide 4 inside of which a friction spring 5 is secured and a through elongated hole 6 is made in the plate 1A between arched members of the guide 4. The base plate 1B has a pivoting hook 7 with an arch-bent arm, a guide pin 8 and a bumper 9 limiting the range of the hook 7 pivoting. The arch bent arm of the hook 7 and the guide pin 8 mate the guide 4 and the friction spring 5.

The base plates 1A and 1B at one end have fasteners 10A and 10B for securing external cover members, at the same time after securing the plate 1A to the side member of a window frame, the fastener 10A is located above the sash rotation axis, whereas after securing the plate 1B to the side member of a sash, the fastener 10A is located below the sash rotation axis.

At the side with the fastening member 3 the base plate 1A has a holder 11 for a spring 12, whose other end is engaged on a slide 13 located in a hole 6.

The slide 13 protrudes at both sides of the base plate 1A and mates the guide pin 8, secured to the base plate 1B, and moving along the guide 4.

When a window sash is taken out of a window frame or it is pivoted to the maximum, the slide 13 is drawn by the spring 12 towards the holder 11. During mounting a window sash in a window frame and during closing a window sash the guide pin 8 is guided into the guide 4 and exerts pressure on the slide 13, moving it away from the holder 11 to the other end of the hole 6 when the window sash is closed. The spring 12 is than extended but the sash stays in the position set by a user thanks to the friction spring 5, which stops the self-movement of the arm of the hook 7 and the guide pin 8 inside the guide 4.

Turning a window handle fully protects against the uncontrolled movement of the window sash and blocks the window against opening. After realising the lock with a window handle the spring 12 balances the weight of the window sash and a user only needs to use little power enforcing sash pivoting to turn the window sash.

Example II

A hinge for a roof window with a pivot sash comprises a hinge part A, secured to the side member of a window frame and a hinge part B secured to the side member of a sash frame. Both hinge parts have base plates 1A and 1B with screw holes 2 for fastening screws with additional fastening members 3 on one surface. At the other surface the base plate 1A has an arch-bent guide 4 inside of which a friction spring 5 is secured and a through, elongated recess 6 is made in the plate 1A between arched members of the guide 4. The base plate 1B has a pivoting hook 7 with an arch-bent arm, a guide pin 8, which protrudes beyond the base plate 1A through the recess 6, and a bumper 9 limiting the range of hook 7 pivoting. The arched arm of the hook 7 and the guide pin 8 mate the guide 4 and the friction spring 5.

The base plates 1A and 1B at one end have fasteners 10A and 10B for securing external cover members, at the same time after securing the plate 1A to the side member of a window frame, the fastener 10A is located above the sash rotation axis, whereas after securing the plate 1B to the side member of a sash, the fastener 10A is located below the sash rotation axis.

At the side with the fastening member 3 the base plate 1A has two holders 11 and 14 located near the bottom edge of the base plate 1A, where a rod 15 is held with a spiral spring 12 and a slide 13. The spring 12 rests with one end against the holder 11 and with the other one it rests against the slide 13. The slide 13 is secured to the pivoting catch 16 mating the guide pin 8. The catch 16 is fitted with a protrusion 17, which limits its pivoting movement at one side.

When a window sash is taken out of a window frame or when it is open and turned to the maximum, the slide 13 is located near the holder 14, and the catch 16 rests with the protrusion 17 against the slide 13 in a position ready to mate the guide pin 8.

During mounting of a window sash in a window frame and during closing a window the guide pin 8 together with the arched arm of the hook 7 is guided into the guide 4 and the recess 6 and slides into the catch 16. During the further movement of the window sash the guide pin 8 slides inside the guide 4 and pulls the catch 16 together with the slide 13 towards the holder 11 and makes the spring 12 compressed. The spring 12 by means of the catch 16 balances the window sash, which stays in any position set by a user thanks to the friction spring 5, stopping the movement of the pin 8 and the hook 7.

Turning a window handle fully protects against uncontrolled pivoting of a window sash and blocks a window against opening. After realising the lock with a window handle the spring 12 balances the weight of the window sash in any position and the window sash stays in a position set by a user thanks to the friction spring 5 while a user only needs to use little power enforcing sash pivoting to turn the window sash.

Example III

A hinge for a roof window with a pivot sash comprises a hinge part A, secured to the side member of a window frame and a hinge part B secured to the side member of a sash frame. Both hinge parts have base plates 1A and 1B with screw holes 2 for fastening screws with additional fastening members 3 on one surface. At the other surface the base plate 1A has an arch-bent guide 4 inside of which a friction spring 5 is mounted and a through, elongated recess 6 is made in the plate 1A between arched members of the guide 4. The base plate 1B has a pivoting hook 7 with an arch-bent arm, a guide pin 8, which protrudes beyond the base plate 1A through the recess 6, and a bumper 9 limiting the range of hook 7 pivoting. The arched arm of the hook 7 and the guide pin 8 mate the guide 4 and the friction spring 5.

The base plates 1A and 1B at one end have fasteners 10A and 10B for securing external cover members, at the same time after securing the plate 1A to the side member of a window frame, the fastener 10A is located above the sash rotation axis, whereas after securing the plate 1B to the side member of a sash, the fastener 10A is located below the rotation sash axis.

At the side with the fastening member 3 the base plate 1A has a guide 18 mounted along the bottom edge of the base plate 1A, restricted at one end by the holder 11. The slide 13 in the form of a rod 13' moves along the guide 18. The rod 13' is secured with one end to a seat 13" while its other end slides through a hole in the holder 11. A spiral spring 12 is slid over the rod 13', one side of the spring 12 is engaged at the free end of the rod 13' and its other side rests against the holder 11. The seat 13" is connected to a pivoting catch 16 mating the guide pin 8. Pivoting of the catch 16 is limited at one side by a cut-out in the seat 13".

When a window sash is taken out of a window frame or when it is open and turned to the maximum, the seat 13 is located near the holder 11, and the catch 16 assumes the position ready to mate the guide pin 8.

During mounting of a window sash in a window frame or during closing a window the guide pin 8 inserted into the guide 4 and the recess 6 slides into the catch 16. During a further movement of the window sash the guide pin 8 slides inside the guide 4 and moves the catch 16 together with the slide 13 away from the holder 11 and enforces compression of the spring 12.

Turning of a window handle fully protects against the uncontrolled pivoting of a window sash and blocks the window against opening. After realising the lock with a window handle the spring 12 by means of the catch 16 balances the window sash, which stays in any position set by a user thanks to the friction spring 5 stopping the movement of the pin 8 and the arm of the hook 7 while a user only needs to use little power enforcing sash pivoting to turn the window sash.

The invention claimed is:

1. Hinge for a roof window with a pivot sash, said roof window comprising a frame and said sash each comprising two side members with side surfaces, top members and bottom members, said frame and said sash being connected by two said hinges, each said hinge comprising two hinge parts, each hinge part each having a base plate with means enabling securing the base plate to the side surface of the side member of the frame and the side member of the sash, the base plate secured to the side member of the frame having at one side an arched-bent guide and the base plate secured to the side member of the sash having at one side a pivoting hook member with an arch bent arm and a guide pin, said guide pin mating with the arched guide, and a bumper limiting the range of hook member pivoting, the hinge being equipped with a braking frictional member, which keeps the sash in a fixed position, wherein the base plate between the arched members of the guide, has located therein a through, elongated recess, and at a side opposite to the arched guide on the plate a mechanism balancing the sash is mounted, said mechanism interacting with the guide pin mounted on the hinge base plate.

2. Hinge as claimed in claim 1, wherein the mechanism balancing the sash comprises a spring and a slide both mounted on the base plate, the slide interacting with the guide pin.

3. Hinge as claimed in claim 2, wherein the slide is located in the elongated recess , between the arched members of the guide, the slide protruding at both sides of the base plate.

4. Hinge as claimed in claim 2, wherein the guide pin, mounted on the base plate, protrudes through the elongated recess beyond the base plate, and the slide is secured to a catch (16), interacting with the guide pin.

5. Hinge as claimed in claim 4, wherein along a bottom edge of the base plate, at the opposite side to the arched guide, a rod with the slide and the spring are mounted in holders, the spring being placed between the holder and the slide.

6. Hinge as claimed in claim 5, wherein the catch assumes a position ready to interact with the guide pin as a result of limiting pivoting movement.

7. Hinge as claimed in claim 4, wherein along a bottom edge of the plate, at the opposite side to the arched guide, a guide is mounted, which interacts with the slide the guide comprising a rod secured with one end to a seat, with an opposite, free end of the rod sliding through a hole in the holder, and the spring slid over the rod is spaced between the holder and the free end of the rod.

8. Hinge as claimed in claim 7, wherein the catch assumes a position ready to interact with the guide pin as a result of limiting pivoting movement.

9. Hinge as claimed in claim 4, wherein the catch assumes a position ready to interact with the guide pin as a result of limiting pivoting movement.

* * * * *